US012458831B2

(12) United States Patent
Munz

(10) Patent No.: US 12,458,831 B2
(45) Date of Patent: Nov. 4, 2025

(54) TRAINING DEVICE

(71) Applicant: Florian D. Munz, Utting am Ammersee (DE)

(72) Inventor: Florian D. Munz, Utting am Ammersee (DE)

( * ) Notice: Subject to any disclaimer, the term of this patent is extended or adjusted under 35 U.S.C. 154(b) by 115 days.

(21) Appl. No.: 18/290,703

(22) PCT Filed: Jul. 18, 2022

(86) PCT No.: PCT/EP2022/070097
§ 371 (c)(1),
(2) Date: Jan. 19, 2024

(87) PCT Pub. No.: WO2023/001778
PCT Pub. Date: Jan. 26, 2023

(65) Prior Publication Data

US 2024/0252871 A1 Aug. 1, 2024

(30) Foreign Application Priority Data

Jul. 22, 2021 (DE) ..... 102021207888.5

(51) Int. Cl.
*A63B 21/06* (2006.01)
*A63B 21/00* (2006.01)
*A63B 23/035* (2006.01)

(52) U.S. Cl.
CPC ..... *A63B 21/0608* (2013.01); *A63B 21/0004* (2013.01); *A63B 21/4035* (2015.10); *A63B 23/03508* (2013.01); *A63B 2225/09* (2013.01)

(58) Field of Classification Search
CPC ..... A63B 21/0004; A63B 21/0608; A63B 21/0726; A63B 21/4035; A63B 23/03508;
(Continued)

(56) References Cited

U.S. PATENT DOCUMENTS 4,632,391 A 12/1986 Orak
4,938,477 A * 7/1990 Kuervers ..... A63B 21/4017 63/3

(Continued)

FOREIGN PATENT DOCUMENTS

AT 11063 4/2010
DE 7141232 7/1972

(Continued)

OTHER PUBLICATIONS

Gyrospinn dynamic training device, https://www.sport-tec.de/gyrospinn-dynamisches-trainingsgeraet, pp. 1-4.

(Continued)

*Primary Examiner* — Joshua Lee

(57) ABSTRACT

The present invention relates to a training device (10) for training the arm muscles and muscle groups associated therewith, comprising:

Figure 1:
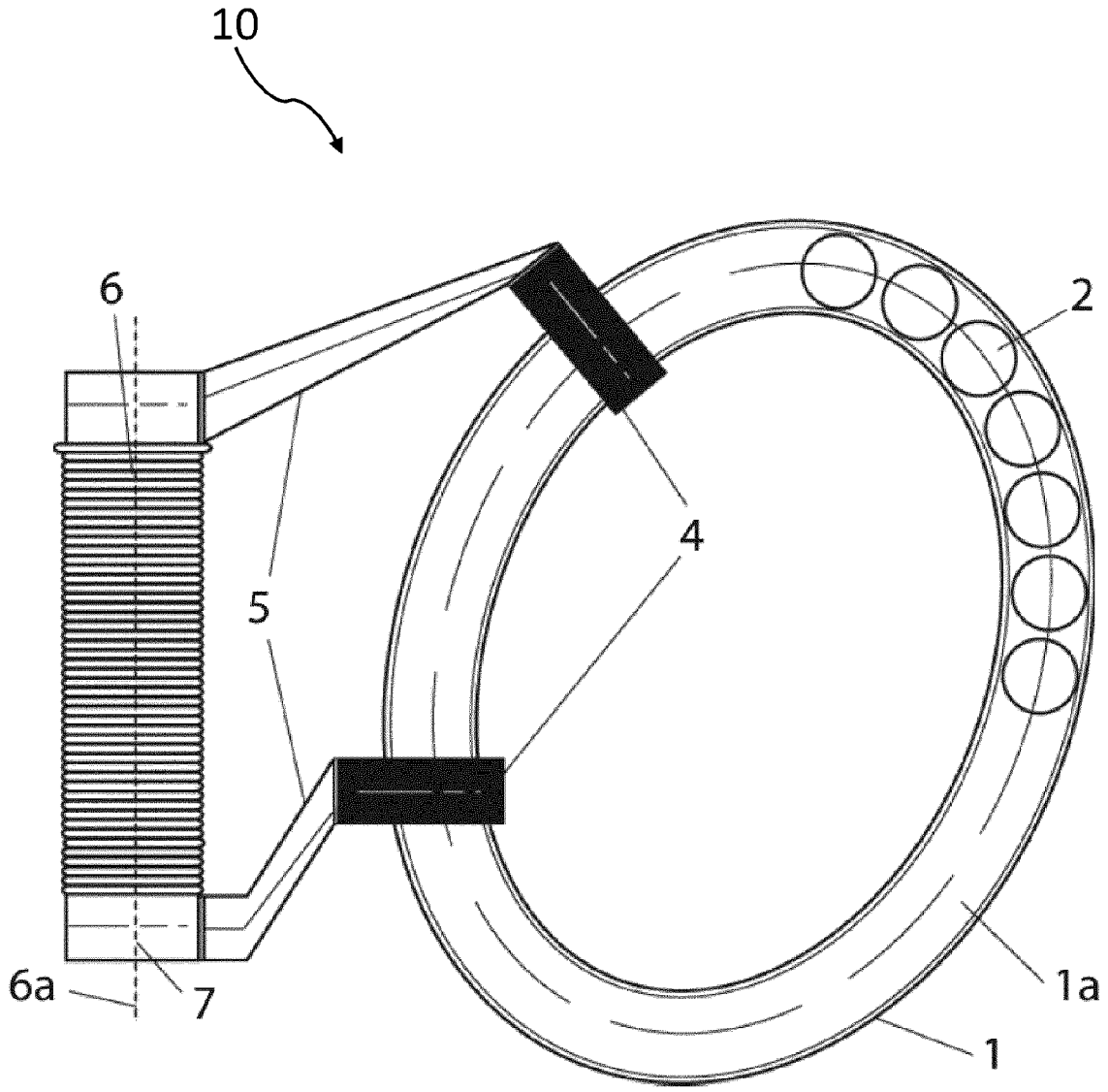

at least one flywheel mass member carrier (1) with at least one flywheel mass member guide (1*a*) for guiding at least one flywheel mass member (2) along at least one elliptical path deviating from a circular shape or at least one elliptical path segment, wherein the flywheel mass member guide (1*a*) forms a guide of the at least one flywheel mass member (2) extending beyond a semi-ellipse and spans a flywheel mass member guide plane (y, z) in the radial direction of the elliptical path or the elliptical path segment, and at least one handle member (6) with a handle axis (6*a*) to be encompassed for gripping, wherein the handle member (6) is arranged in the handle axis (6*a*) at least sectionally in a handle plane (6*b*) which extends perpendicular to the flywheel mass member guide plane (y, z) and which does not intersect the elliptical path or the elliptical path segment.

20 Claims, 5 Drawing Sheets

(58) Field of Classification Search
CPC ..... A63B 23/1209; A63B 2071/0655; A63B 2071/0694; A63B 2225/09
See application file for complete search history.

(56) References Cited

U.S. PATENT DOCUMENTS

| | | | | |
|---|---|---|---|---|
| 6,099,444 | A | 8/2000 | Domenge | |
| 6,450,928 | B1 * | 9/2002 | Larkins, Jr. | A63B 21/0608 482/106 |
| 7,563,210 | B2 * | 7/2009 | Smith | A63B 21/0004 482/110 |
| 7,935,035 | B2 * | 5/2011 | Smith | A63B 21/22 482/44 |
| 8,814,765 | B2 * | 8/2014 | Bernstein | A63B 21/4035 482/110 |
| D847,918 | S | 5/2019 | Reisinger | |
| 10,918,898 | B1 * | 2/2021 | Palacios | A63B 21/0603 |
| 11,517,783 | B2 * | 12/2022 | Hamady | A63B 21/4035 |
| 11,896,865 | B2 * | 2/2024 | Hamady | A63B 21/0618 |
| 2005/0096200 | A1 * | 5/2005 | Amann | A63B 21/0602 482/110 |
| 2008/0153676 | A1 | 6/2008 | Krietzman | |
| 2009/0280967 | A1 | 11/2009 | Salzwimmer et al. | |
| 2011/0224054 | A1 | 9/2011 | Bernstein | |
| 2013/0184123 | A1 * | 7/2013 | McLoughney | A63B 22/18 482/8 |
| 2021/0113882 | A1 | 4/2021 | Spindlberger | |

FOREIGN PATENT DOCUMENTS

| | | |
|---|---|---|
| DE | 9200974 | 3/1992 |
| DE | 20007600 | 7/2000 |
| DE | 202007006734 | 8/2007 |
| GB | 2361876 | 7/2001 |
| GB | 2561888 | 10/2018 |
| JP | 2005278840 | 10/2005 |
| WO | 2007140502 | 12/2007 |
| WO | 2012041929 | 4/2012 |

OTHER PUBLICATIONS

Florian D. Munz, Training device for strengthening the arm, shoulder and core muscles, primarily during jogging, fast running and sprinting, @ 2021 Florian D. Munz—Utting a.A—Germany.

* cited by examiner

TRAINING DEVICE

CROSS REFERENCE TO RELATED APPLICATION

This patent application claims the benefit and priority of PCT/EP2022/070097, having an international filing date of Jul. 18, 2022, which claims priority to German Patent Application No. 102021207888.5, having a filing date of Jul. 22, 2021, the disclosure of which is incorporated by reference herein in its entirety as part of the present application.

The present invention relates to a training device.

Training devices for training the arm muscles and muscle groups associated therewith can be held by hand during jogging or similar walking activities in order to achieve an additional effect in addition to endurance training. For example, comparatively small dumbbells are used as training devices during jogging. During forward and backward swinging of the arms, the dumbbells are accelerated and decelerated again. At the reversal point, the mass of the dumbbells tears with high force on the muscles and joints, which can quickly lead to overloading and injury to the musculoskeletal system. In addition, dumbbells have disadvantageous effects on the running technique. For walking (sporty walking), there are also some training devices which move a dynamic flywheel mass forward and backward. The delayed acceleration and deceleration of the flywheel mass reduces the tearing on the muscles and joints. With increasing running speed, however, the force peaks at the reversal point of the arm swing increase again and the same problems occur as with classical dumbbells.

A further training device for muscle strengthening is a ring with flywheel masses guided in a circular path within the ring. The training device has a handle which lies centrally within the ring and connects two opposite ring sides. The handle is thus located internally of the running path of the flywheel mass. Such a training device is known, for example, from US 2011/0224054 A1 or also EP 2 621 591 A1. The lever arm on the flywheel mass is thereby limited to the radius of the ring. In addition, lever arms may act which are directed opposite a running direction. As a result, negative load phenomena and effects on the running technique may likewise occur.

In view of the above, the object of the present invention is to provide a training device by which ergonomic muscle training for strengthening the arm, shoulder and/or torso muscles during a running activity can be enabled.

The object is achieved by a training device according to independent claim 1. Advantageous developments of the invention are contained in the dependent claims.

According to the invention, a training device for training the arm muscles and muscle groups associated therewith comprises at least one flywheel mass member carrier with at least one flywheel mass member guide for guiding at least one flywheel mass member along at least one elliptical path or an elliptical path segment deviating from a circular shape. The flywheel mass member guide forms a guide of the at least one flywheel mass member extending beyond a semi-ellipse and spans a flywheel mass member guide plane in the radial direction of the elliptical path or the elliptical path segment. In addition, the training device comprises at least one handle member with a handle axis to be encompassed for gripping. The handle member is arranged in the handle axis at least sectionally in a handle plane which extends perpendicular to the flywheel mass member guide plane and which does not intersect the elliptical path or the elliptical path segment.

The flywheel mass member guide is formed such that the at least one flywheel mass member is guided along an elliptical path or at least one elliptical path segment deviating from a circular shape. The circular shape ultimately corresponds to a special shape of the ellipse with an eccentricity of zero. In other words, in the case of a circle, the radius is constant. If the at least one elliptical path is formed by the flywheel mass member guide, i.e. a flywheel mass member guide of 360° in elliptical shape, this deviates from the aforementioned circular shape. However, the at least one elliptical path segment may in turn be formed as a circular path segment as a corresponding special shape of the elliptical path segment, if this circular path segment as the sole flywheel mass member guide does not extend over 360° and thus forms a circular path as the sole flywheel mass member guide. In other words, the flywheel mass member guide has either a path of 360° deviating from a circular shape or at least one elliptical path segment, which may also comprise a circular path segment as a special shape of the elliptical path segment, wherein then the flywheel mass member guide as a whole does not form a sole flywheel mass member guide in the shape of a circle. Accordingly, the flywheel mass member guide may indeed also contain a circular path in addition to a circular segment, wherein then even further elliptical path segments extending beyond the circular path, i.e. over 360°, adjoin.

In the case of a flywheel mass member guide formed as a circular path, a flywheel mass member may be rotated in a comparatively simple manner circumferentially in one direction. In contrast thereto, an elliptical path deviating from the circular shape as a flywheel mass member guide or a flywheel mass member guide composed of elliptical path segments, which however may also be circular path segments, may alternatively or additionally support a pendulum movement of a flywheel mass member. A pendulum movement is characterized by two swing phases and two reversal phases. By virtue of the elliptical shape of the flywheel mass member guide deviating as a whole from the circular shape, the movement of the at least one flywheel mass member may be adapted to the duration of the swing phases and the reversal phases. In the case of an elliptical path deviating from a circular shape as a flywheel mass member guide, the flywheel mass member guide comprises for example a main axis, which represents the largest diameter, and a secondary axis according to a smallest diameter. If the main apex points of the flywheel mass member guide with respect to the main axis are arranged in the direction of gravity above and below the secondary apex points with respect to the secondary axis during use in accordance with the application, the length of the main axis determines the duration of the forward and backward swing phase. The length of the secondary axis determines the duration of the reversal phases. In the radius around the main apex points, the load peaks, which arise during the swing of solid dumbbells or during the rapid swing of devices with shock absorbers at the reversal points of the arm swing, are absorbed. In the case of a flywheel mass member guide in circular shape, the movement may be adapted via the radius either to the swing phase or the reversal phase, but not to both phases. The arrangement of the handle member or the handle axis, respectively, outside the flywheel mass member guide makes it possible, for example, to change the angle of the handle axis with respect to the flywheel mass member guide, as will be discussed later with respect to a positioning and adjustment.

In the case of an elliptical path or substantially elliptical shape of the flywheel mass member guide, for example, the acceleration of the flywheel mass member may thereby be adapted to the pendulum movement of the arms. In the case of a circular shape, the change in the angle has no effect.

By means of the at least one elliptical or correspondingly also circular path segment, different flywheel mass member guides, such as, for example, at least sectionally oval flywheel mass member guides, may be formed in connection with otherwise shaped path segments, such as, for example, straight lines. In an embodiment, the flywheel mass member guide may be composed of individually connectable path segments in different configurations, so that the respective shape may be individually adapted to the training purpose and/or individual preferences. The elliptical path or the at least one elliptical path segment may also be composed of different elliptical and/or circular path segment portions. The elliptical and/or circular path segment portions have one or more center points which lie on one side of the flywheel mass member guide. The elliptical and/or circular path segment portions are accordingly curved in one direction.

A plurality of flywheel mass member guides may also be provided next to one another and/or above or behind one another. The following explanations concerning design and/or positioning possibilities of the at least one flywheel mass member guide may thus also be transferred to further flywheel mass member guides of the training device. In the case of a plurality of flywheel mass member guides, the individual flywheel mass member guides do not have to be of the same design and/or positionable, but may differ at least partially in their respective characteristics.

On account of the curvature of the elliptical path or an elliptically formed path segment, the path or the path segment has a two-dimensional extent which spans a flywheel mass member guide plane. In other words, the flywheel mass member guide plane may also be formed by the radius, that is to say a straight line from the center of the elliptical path or the elliptically formed path segment, with the elliptical path or the elliptically formed path segment. A radial direction with respect to the flywheel mass member guide correspondingly corresponds to the direction from the respective center of the elliptical path or the elliptical path segment to the elliptical path or the correspondingly formed path segment, that is to say a direction of the radius. The flywheel mass member guide may, but does not have to, run exclusively in the two-dimensional extent. The flywheel mass member guide may for example also additionally extend in a direction perpendicular to the radius, such that the ends of the path or of the path segment are offset with respect to one another in this direction. Accordingly, the flywheel mass member guide may for example be formed as a spiral or spiral segment or contain the latter.

The flywheel mass member guide forms a guide of the at least one flywheel mass member extending beyond a semi-ellipse. The flywheel mass member guide thus has at least three apex points, wherein these are at least two main apex points lying within the guide and at least one secondary apex point. Accordingly, the main apex points lie within the guide or the flywheel mass guide extends beyond the main apex points. If the main axis of the ellipse forms the y-axis and the secondary axis of the ellipse forms the x-axis of a coordinate system, the algebraic sign of the slope of a tangent to the ellipse reverses in the main apex points.

Depending on the posture of the training device during use in accordance with the application, the main apex points may for example be assigned to a reversal phase, while the secondary apex point substantially relates to the swing phase. During use of the training device in accordance with the application, the main apex point for the reversal phase lies for example in a region of the flywheel mass member guide facing away from the direction of gravity, that is to say in an upper region with respect to gravity, such that the flywheel mass is decelerated during a movement toward the apex point. Load peaks may be avoided or at least reduced by the deceleration of the flywheel mass. In addition, depending on the embodiment of the training device, an impulse for a backward swing or a backward swinging may be achieved by this means. In addition, sufficiently long swing and/or reversal phases may be provided by the flywheel mass member guide extending beyond a semi-ellipse.

With respect to an arm swing carried out for example during jogging, the load peaks, which arise during the swing of solid dumbbells at the reversal points of the arm swing, may accordingly be prevented after the forward swing phase of the arm in the reversal phase by the flywheel mass being decelerated around the upper main apex point of an elliptical path or toward the latter. The flywheel mass then moves at the reversal point of the arm swing opposite to the previously carried out forward swing movement of the arm and provides an impulse for the backward swing of the arm. The analogous situation may apply if the arm or training device swings back at the lower main apex of the elliptical path. These two effects lead to a harmonic swing behavior of the training device, for example, during jogging. The effect of the impulse for the backward swing is achieved in particular if the elliptical path, as an example of an elliptical path, but also of a flywheel mass member guide with at least one elliptical path segment with corresponding properties, extends flat enough due to the positioning of the handle axis or corresponding rotation, so that the flywheel mass is not accelerated too much downward by gravity and is then rotated or pressed against a possibly present shock absorber or strikes against the shock absorber during rapid swing.

The handle member of the training device has a handle axis to be encompassed for gripping. The handle axis extends substantially in one direction, i.e. even in the case of a curvature of the handle member, on average a handle axis may be determined which corresponds to an axis which passes through fingers of a hand lying one above the other when the handle is enclosed within the enclosed space. Due to the fact that the handle member in the handle is arranged axis at least sectionally in a handle plane which extends perpendicular to the flywheel mass member guide plane and which does not intersect the elliptical path or the elliptical path segment, the handle member lies in a radial direction at least sectionally outside the elliptical path or the elliptical path segment. In particular, the handle member in the handle axis lies completely in the handle plane so that it is also arranged completely outside the elliptical path or the elliptical path segment in the radial direction in each handle position. The handle member may also be arranged in the handle axis at least sectionally in the handle plane so that the handle member intersects the handle plane. For example, the handle member may be rotated in two axes with respect to the handle plane, wherein a section is still arranged in the handle plane due to the intersection of the handle plane. The handle axis may also be arranged perpendicular to the handle plane so that although the handle axis may intersect the flywheel mass member guide plane, a part of the handle member itself is still arranged in the handle plane in the direction of the handle axis since it intersects the handle plane. This part of the handle member then lies outside the flywheel mass member guide. In other words, the at least sectional arrangement of the handle member in the handle plane relates to a configuration in which a physical part of the handle member is located in a region which lies outside the flywheel mass member guide in the radial direction. The handle member or the handle axis, respectively, relates to a handle or handle section provided for gripping during use in accordance with the application. Even if a training device for arranging the handle has for example bridge connections or the like which may be gripped, such members do not correspond to a handle member for use in accordance with the application. This is also explained by the fact that such members are not present in the arrangement described above, but lie in an axis or plane, respectively, which intersect the elliptical path or the elliptical path segment for connection. The handle member may alternatively or additionally also be formed by a handle-equivalent fastening member for fastening to a hand, a wrist and/or an arm section. For example, such a handle-equivalent fastening member may be a glove or a cuff which reproduces the function of a handle member and is thus likewise understood as a handle member. The handle axis of such a handle-equivalent fastening member as a handle member then relates to the axis which would have to be encompassed if a handle to be encompassed were provided instead of the handle-equivalent fastening member. In other words, in the case of a glove or a cuff which is arranged around a wrist, the handle axis substantially corresponds to the axis which the fingers of a respective hand would encompass if they were balled into a fist.

Since the respectively arranged handle member can be held in the radial direction in a position outside the elliptical path or the elliptical path segment, the lever arm for the at least one flywheel mass member is always at least partially directed in one direction. By virtue of this arrangement of the handle member, the force transmission by the movement of a runner via the handle member to the at least one flywheel mass member is more effective than if the handle member were located within or on the flywheel mass member guide. The vector of the lever arm of the handle member on the at least one flywheel mass is likewise at least partially always directed in the running direction when the training device is in a posture in accordance with the application in the running direction, for example defined as the z-direction. In other words, the z-coordinate, as the coordinate in the running direction, is always positive. As a result, the runner may optimally adapt a movement speed of the at least one flywheel mass along the flywheel mass member guide to his running rhythm. By virtue of a sufficiently large distance of the handle member from the flywheel mass member guide and thus from the guide of the at least one flywheel mass member, this also applies if the handle member of the wrist is held obliquely or tilted, as a result of which the distance of the handle member from the flywheel mass member guide is reduced in the running direction. Such oblique holding of the handle occurs for example during forward and backward swinging of the arms during running.

The handle member lying outside the flywheel mass guide or the handle axis lying outside the flywheel mass member guide in combination with the elliptical path or the elliptical path segment enables tilting and spacing of the handle member in relation to the flywheel mass member guide, as a result of which the movement behavior of the flywheel mass may be influenced.

According to a development, the flywheel mass member guide forms a guide channel in which the at least one flywheel mass member is guided along the elliptical path or the elliptical path segment.

The guide channel surrounds the at least one flywheel mass member perpendicular to the guide direction at least sectionally. In such a case, the at least one flywheel mass member is thus guided within the flywheel mass member guide. For this purpose, the flywheel mass member guide may be formed in a simple configuration as a tubular member, rigid or flexible, the inner diameter of which is greater than the outer diameter to be guided or the outer dimension to be guided of the at least one flywheel mass member. The tubular member may also be formed from rigid and flexible sections. The at least one flywheel mass member may be a sphere, for example. Other shapes of the inner contour of the flywheel mass member guide and/or of the at least one flywheel mass member are possible, wherein the respective shapes or dimensions of the flywheel mass member guide and of the at least one flywheel mass member are to be matched to one another in order to carry out a relative movement between the flywheel mass member guide and the at least one flywheel mass member.

As an alternative to guiding the at least one flywheel mass member within the flywheel mass member guide, the at least one flywheel mass member may also be guided along the outside of the flywheel mass member guide. For this purpose, the at least one flywheel mass member and the flywheel mass member guide may form a form-fit, for example, which has sufficient clearance for a relative movement. For example, the at least one flywheel mass member may have the negative shape of a flywheel mass member guide profile and be guided on a guide track in a manner comparable to a carriage, as known inter alia from dovetail guides and the like.

The at least one flywheel mass member may also be guided sectionally on the inside and on the outside of the flywheel mass member guide. It is likewise possible for a plurality of flywheel mass members to be provided, wherein at least one flywheel mass member is guided on the outside and at least one flywheel mass member is guided on the inside. Accordingly, a plurality of flywheel mass member guides may also be provided.

In an embodiment, the flywheel mass member guide forms a continuous at least sectionally elliptical path or sectionally circular path for continuously guiding the at least one flywheel mass member.

Accordingly, the flywheel mass member guide is a closed path, such that the at least one flywheel mass member may be guided circulatory. The closed path forms an elliptical path at least sectionally. If the flywheel mass member guide has circular path segments, these are provided only sectionally, such that no path in a circular shape is formed thereby, which serves solely for the flywheel mass guide. Overall, however, circular sections of the flywheel mass member guide may be provided, to which further flywheel mass member guide sections then adjoin.

The guide path of the at least one flywheel mass is thus not limited and the at least one flywheel mass member may rotate along the flywheel mass member guide. The at least one flywheel mass member may thus be moved continuously in one direction without mechanical reversal points. Due to the omission of mechanical reversal points, force peaks at the reversal points of the arm swing during running may be avoided. In addition, the closed continuous flywheel mass member guide may allow a rotation of the flywheel mass member or of individual flywheel mass members in the event of faults in the execution of the sporting technique, which possibly provides only a swinging of the flywheel mass member or of individual flywheel mass members in the sense of a forward and backward movement.

In order to achieve a pendulum movement, i.e. a forward and backward rotation, of the at least one flywheel mass member, it is also possible to configure the flywheel mass member guide to be open, so that no continuous closed path is provided in the sense of the connection of end points, such as, for example, in the case of a spiral shape with non-interconnected ends or other shape configurations with offset ends. Alternatively, for a pendulum movement, at least one stop may also be provided in or on the flywheel mass member guide, which limits the movement of the at least one flywheel mass member along the flywheel mass member guide. In the case of an externally closed flywheel mass member guide or a flywheel mass member guide, which surrounds the at least one flywheel mass member such that it is held in the flywheel mass member guide, the stop may be formed as a wall or a closure. The stop may be or comprise a damping member.

The continuous at least sectionally elliptical path may also be formed from different elliptical path segments. The continuous path may also comprise intermediate path segments, such as straight sections, deviating from an elliptical path. The circulation of the at least one flywheel mass member is sufficiently supported by the nevertheless substantially elliptical overall shape of the path.

In particular, perpendicular from the radial center point of the at least partially elliptical path or the partially circular path on the handle plane, a radial distance from the radial center point of the at least partially elliptical path or the partially circular path to the handle plane is greater than a radial distance from the radial center point of the at least partially elliptical path or the partially circular path to the at least partially elliptical or to the partially circular path.

The handle member is thus located at least sectionally, in particular a central section of the handle member along the handle axis, outside the running path of the at least one flywheel mass member along the flywheel mass member guide. If this condition is observed in any position of the handle member relative to the flywheel mass member guide, the advantage associated with the respective lever arm may also be achieved in the event of a change in the relative position of the handle member to the flywheel mass member guide.

In an embodiment, the flywheel mass member guide is elastically deformable via at least one tensioning member.

The shape of the elliptical path or the elliptical path segment may be adapted via the elastic deformability. Depending on the elasticity of the flywheel mass member guide, the tensioning member may also increase the dimensional stability of the flywheel mass member guide.

The at least one tensioning member may for example be designed as an elastic rubber band, the ends of which may be arranged on two substantially opposite path sections. Alternatively, a substantially inelastic tension member, such as a nylon cable, may also be used as the tensioning member. The term "substantially" relates to the fact that material-related elastic deformation portions of the respective tensioning member are not significant, so that vibrations may for example be avoidable. An inelastic tensioning member may also be fastened to the flywheel mass member guide or the flywheel mass member carrier with an elastic fastening means. In a further configuration variant, threaded rod tensioning members or also spacers may be used between such path sections. The at least one tensioning member may be adjustable for different deformation of the flywheel mass member guide and/or may be positionable at different positions along the flywheel mass member guide. A plurality of identical or different tensioning members may also be provided. The tensioning member may also be a tensioning member acting in two axial directions, i.e. as a cross member, in order not to use two separate tensioning members and to be able to further increase the dimensional stability. The described tensioning members may be combined with one another.

According to an embodiment, the handle axis is positionable via at least one spacer member and/or at least one fastening member at a predetermined distance and/or at a predetermined angle in three axes to the flywheel mass member guide.

The spacer member is formed for example from a bridge extending at an angle away from the handle axis. The fastening member may be a mount fastenable to the flywheel mass member guide or the flywheel mass member carrier, which in turn is fastenable to the spacer member or the handle member. The fastening member may also be formed integrally with the spacer member, so that one end of the spacer member is fastenable to the flywheel mass member guide or the flywheel mass member carrier and the other end is fastenable to the handle member. The spacer member may also be formed integrally with the handle member. Likewise, the handle member, the spacer member and the flywheel mass member guide or the flywheel mass member carrier, respectively, may be formed integrally. In this case, a fastening member may be dispensed with due to the integral configuration. The spacer member and/or the fastening member may be shaped as desired. Preferably, the spacer member and/or the fastening member are formed such that the distance between the handle member and the flywheel mass member guide or the flywheel mass member carrier is sufficient for encompassing the handle member. In particular, the distance is predetermined by the spacer member and/or the fastening member according to a desired minimum and/or maximum lever arm. In an exemplary embodiment, the flywheel mass member carrier may also integrally form the handle member, the spacer member and the flywheel mass member guide. However, a separate configuration of the handle member, the spacer member, the fastening member and/or the flywheel mass member guide or the flywheel mass member carrier, respectively, enables a flexible exchangeability of these components, so that weights and lever arms may be individually adjusted.

The predetermined distance of the handle axis to the flywheel mass member guide does not have to be constant over the handle length. The predetermined distance with respect to a handle axis with respect to an ellipse changes over the handle length, wherein the predetermined distance is predetermined as a function over the handle length.

In addition, the handle axis may be positioned at a predetermined angle with respect to the three axes of a Cartesian coordinate system. The predetermined angle may result from tilting or tipping, respectively, or also rotating the handle member or the handle axis, respectively, with respect to the flywheel mass member guide. Ultimately, each position of the handle axis with respect to the flywheel mass member guide is defined by a predetermined angle in the three axes, wherein the angle may also be zero. In an embodiment, the handle axis is twisted in all three axes with respect to the flywheel mass member guide or a flywheel mass member guide plane, respectively.

In particular, the at least one spacer member and/or the at least one fastening member is configured to oscillate.

The at least one spacer member and/or the at least one fastening member may thus execute comparatively small movements in at least one spatial direction. As a result, muscle groups may be further targeted compared to a rigid configuration of the at least one spacer member and/or the at least one fastening member. For the oscillating configuration, the spacer member and/or the fastening member may be formed at least sectionally from a flexible material. Alternatively or additionally, the at least one spacer member and/or the at least one fastening member is mounted with clearance, so that, for example, relative movements between the handle member and the at least one spacer member and/or between the at least one spacer member and the at least one fastening member and/or between the at least one fastening member and the flywheel mass member guide or the flywheel mass member carrier, respectively, are possible.

In a development, the positioning of the handle axis in relation to the flywheel mass member guide is variable via the at least one spacer member and/or the at least one fastening member.

Due to the variable positioning of the handle axis, the training device may be individually adapted to the runner, different wrist positions and/or different muscle groups to be targeted. The variable positioning may take place manually and/or via a drive.

In particular, a pivot angle of the flywheel mass member guide about an axis perpendicular to the flywheel mass member guide plane relative to the handle axis, is variable via the at least one spacer member and/or the at least one fastening member, in particular in a range from 0 to 180°, preferably from 0 to 90°.

For this purpose, the handle member and/or the flywheel mass member guide or the flywheel mass member carrier may be mounted, for example, in an articulated manner on the at least one spacer member and/or the at least one fastening member, so that the flywheel mass member guide may be pivoted perpendicular to the flywheel mass member guide plane relative to the handle axis via such a joint. In the case of more than one spacer member, at least one spacer member not associated with the joint is then configured in such a manner that it can compensate for a pivoting movement, such as, for example, by a telescopic configuration of the spacer member. Alternatively, a connection to such a spacer member may also be released at least temporarily.

The acceleration behavior of the at least one flywheel mass member along the flywheel mass member guide may be adapted by the tilting of the flywheel mass member guide about an axis perpendicular to the flywheel mass member guide plane relative to the handle axis resulting from the pivot angle. In the case of an elliptical flywheel mass member guide, i.e., the guiding of the at least one flywheel mass member along an elliptical path, in which the long side is initially oriented at 0° perpendicular to the ground or the short side points in the running direction, the vertical climbing height is reduced in the case of an inclination in the direction of the ground in the running direction, but the horizontal path component is lengthened. In the case of pivot angles beyond 180°, starting from a vertical arrangement of the long side of the elliptical path, the at least one flywheel mass member would have to be accelerated upward opposite the running direction. Accordingly, pivot angles between 0° and 180° have a more favorable acceleration behavior of the at least one flywheel mass member during a running training and movement sequences associated therewith. The pivot angle range of 0° to 180° thus relates here to a range in which no negative lever arm occurs with respect to the running direction. The angle of 0° for a pivoting over a range of 0° to 180° then lies in the flywheel mass member guide plane perpendicular to the running direction in the direction of the positive axis y. However, the pivot range may also be restricted to 0° to 90°, since the training device may also be pivoted about the axis pointing in the running direction, so that all angle ranges of 0° to 180°, as described above, may be achieved by turning over the training device. The initial angle of 0° for a pivoting over a range of 0° to 90° then lies in the running direction on the axis z. However, the initial angle for a respective pivoting may also relate to another predetermined initial position. In other words, a pivot angle of the flywheel mass member guide about an axis perpendicular to the flywheel mass member guide plane relative to the handle axis is variable via the at least one spacer member and/or the at least one fastening member with respect to a predetermined initial position of the flywheel mass member guide, in particular in a range from 0 to 180°, preferably from 0 to 90°.

The pivot point for the pivot angle of the flywheel mass member guide about an axis perpendicular to the flywheel mass member guide plane relative to the handle axis may correspond to a radial center of the flywheel mass member guide. Alternatively, however, the pivot point may also lie approximately on the flywheel mass member guide, i.e. be formed, for example, by the articulated fastening to the at least one spacer member or fastening member. In a further alternative, the pivot point is formed by the articulated mounting of the spacer member on the handle member.

The pivot angle of the flywheel mass member guide about an axis perpendicular to the flywheel mass member guide plane relative to the handle axis may be provided instead of a radial abduction and/or an ulnar abduction of the wrist or may be superimposed thereon. If the pivot angle can replace at least the radial abduction, the pivot angle is at least up to approximately 15° in a direction facing away from the ground during running or in the direction of a radial abduction, i.e. upward during a running training, starting from a predefined initial position. If the pivot angle can alternatively or additionally replace at least the ulnar abduction, the pivot angle is at least up to approximately 40° in a direction facing the ground during running or in the direction of an ulnar abduction, i.e. downward during a running training, starting from a predefined initial position.

Alternatively or additionally, a pivot angle of the flywheel mass member guide about an axis in the flywheel mass member guide plane and perpendicular to the handle plane relative to the handle axis, is variable via the at least one spacer member and/or the at least one fastening member, in particular in a range from +90° to −90°, preferably from +45° to −45°.

An articulated mounting, as described above, may also be provided for such a pivoting movement, wherein the joint axis is an axis in the flywheel mass member guide plane and perpendicular to the handle plane. Pivot angles in different directions may also be achieved via a lockable ball joint.

Starting from a parallel arrangement of the flywheel mass member guide plane and the handle member or the handle axis, respectively, the flywheel mass member guide may thus be inclined about an axis in the flywheel mass member guide plane and perpendicular to the handle plane relative to the handle axis. An inclination beyond 90° in one or the other direction, however, hardly enables a uniform movement or rotation of the at least one flywheel mass member along the flywheel mass member guide to be triggered by the arm movement during running. However, individual wrist rotations and/or shoulder joint rotations of an athlete may be at least partially compensated by smaller inclinations, in particular up to +/−45°.

The pivot angle of the flywheel mass member guide about an axis in the flywheel mass member guide plane and perpendicular to the handle plane relative to the handle axis may be provided instead of a pronation and/or a supination of the hand or may be superimposed thereon. If the pivot angle can replace at least the pronation, the pivot angle is at least up to approximately 45° in the direction of a pronation about the axis z in the running direction, i.e. from top inwards to the body center, starting from a predefined initial position. If the pivot angle can alternatively or additionally replace at least the supination in the case of a bent elbow, the pivot angle is at least up to approximately 90° in the direction of a supination about the axis z in the running direction, i.e. from top outwards away from the body center, starting from a predefined initial position. Here, the pivot angle relates to an initial position of 0° in a parallel orientation of the flywheel mass member guide to the handle axis. However, other predetermined initial positions may alternatively also be adjustable. In other words, a pivot angle of the flywheel mass member guide about an axis in the flywheel mass member guide plane and perpendicular to the handle plane relative to the handle axis is variable via the at least one spacer member and/or the at least one fastening member with respect to a predetermined initial position of the flywheel mass member guide, in particular in a range from +90° to −90°, preferably from +45° to −45°.

Alternatively or additionally, a pivot angle of the flywheel mass member guide about an axis in the flywheel mass member guide plane and parallel to the handle plane relative to the handle axis, is variable via the at least one spacer member and/or the at least one fastening member, in particular in a range from +90° to −90°, preferably from +22.5° to −22.5°.

Comparable to a pivot angle of the flywheel mass member guide about an axis in the flywheel mass member guide plane and perpendicular to the handle plane relative to the handle axis, also, alternatively or additionally, a pivot angle of the flywheel mass member guide about an axis in the flywheel mass member guide plane and parallel to the handle plane relative to the handle axis enables compensation of a wrist rotation. Accordingly, in the event of a conventional hand position of a runner not pointing in the running direction, the flywheel mass member guide may nevertheless be oriented in the running direction.

Here, too, an articulated mounting may be provided for implementing the pivot angles. Here, the articulated mounting comprises at least one joint axis in the flywheel mass member guide plane and parallel to the handle plane.

The pivot angle of the flywheel mass member guide about an axis in the flywheel mass member guide plane and parallel to the handle plane relative to the handle axis may be provided instead of a dorsal extension and/or a palmar extension or may be superimposed thereon. If the pivot angle can replace at least the dorsal extension, the pivot angle is at least up to approximately 45° away from the runner outwards starting from a predefined initial position. If the pivot angle can alternatively or additionally replace at least the palmar extension, the pivot angle is at least up to approximately 60° towards the runner inwards starting from a predetermined initial position. For example, an arrangement in which the flywheel mass member guide plane points in the running direction may be the predetermined initial position of the flywheel mass member guide. Alternative initial positions are possible. In other words, a pivot angle of the flywheel mass member guide about an axis in the flywheel mass member guide plane and parallel to the handle plane relative to the handle axis is variable via the at least one spacer member and/or the at least one fastening member with respect to a predetermined initial position of the flywheel mass member guide, in particular in a range from +90° to −90°, preferably from +22.5° to −22.5°.

Alternatively or additionally, a distance of the flywheel mass member guide relative to the handle axis is variable via the at least one spacer member and/or the at least one fastening member in at least one direction in the flywheel mass member guide plane and/or in a direction perpendicular to the flywheel mass member guide plane.

For this purpose, the at least one spacer member may be of telescopic configuration, for example, or may be fastenable to the fastening member and/or handle member in different positions and thus at different distances. The connection between the spacer member and the fastening member and/or the handle member may alternatively or additionally also be of articulated configuration, such that the handle member may assume a varied distance from the flywheel mass member guide in the radial direction by tilting about an axis perpendicular to the flywheel mass member guide plane.

Furthermore, alternatively or additionally, the fastening member may likewise be fastenable to the flywheel mass member carrier or the flywheel mass member guide in different positions, in order to be able to likewise adjust the distance between the handle axis and the flywheel mass member guide.

In an embodiment, the handle member is configured for attaching at least one weight member, in particular in the region of at least one end of the handle member with respect to the handle axis, and/or comprises the latter.

The at least one weight member may, for example, be arranged on the handle member such that the at least one weight member forms a balancing weight with respect to the flywheel mass member carrier. This enables a joint-protecting hand position, since a radial abduction generated by the weight and the lever arm of the training device may be avoided. Preferably, the weight member is arranged in an end region of the handle member with respect to the handle axis. The handle member may be formed such that at least one end region of the handle member comprises a weight member receptacle, for example a thread, in order to be able to fasten one or more weight member(s) to the handle member. The number of weight members and/or the weight to be attached is thereby flexibly adjustable. However, the at least one weight member may also be an additional weight, which serves primarily for additional weight reception.

According to an embodiment, the type and/or number of flywheel mass members is variable.

The flywheel mass to be moved may thus be influenced by selecting the type and/or number of flywheel mass members. The type of flywheel mass member comprises the material and/or the shaping, so that the selection of the type also determines the weight and/or the running characteristics of the at least one flywheel mass member along the flywheel mass member guide. The selection may thus be carried out according to the desired characteristics of the training device. The weight may alternatively or additionally also be variable via the number of flywheel mass members. For exchanging or for feeding and removing flywheel mass members, the flywheel mass member carrier or the flywheel mass member guide, respectively, has a reclosable opening, for example.

In an embodiment, the flywheel mass member guide at least in a possible contact region with the at least one flywheel mass member and/or the at least one flywheel mass member has a profiling and/or coating.

The friction of the at least one flywheel mass member in contact with the flywheel mass member guide may be influenced by the profiling and/or coating. This enables a desired setting of a kinesthetic, tactile and/or acoustic perception by the runner. The training device may also be configured such that the flywheel mass member guide is exchangeable for setting different kinesthetic, tactile and/or acoustic characteristics.

Figure 2:
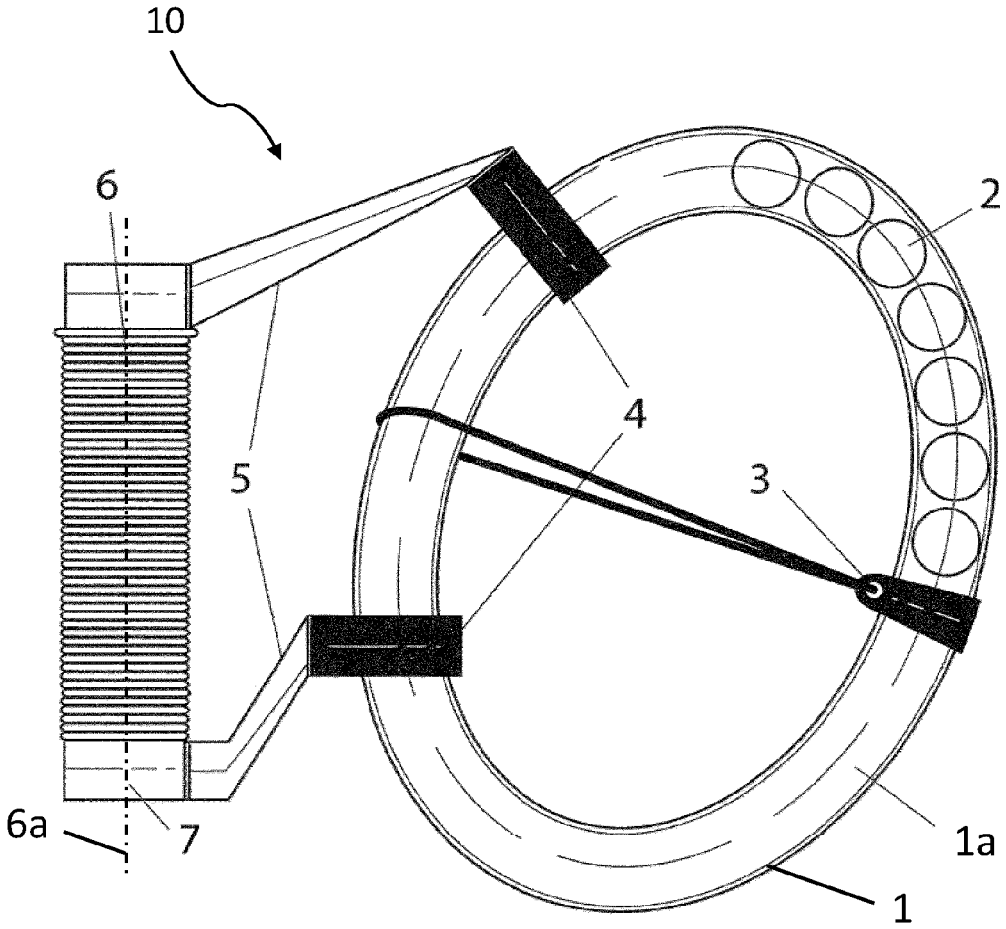
Figure 3:
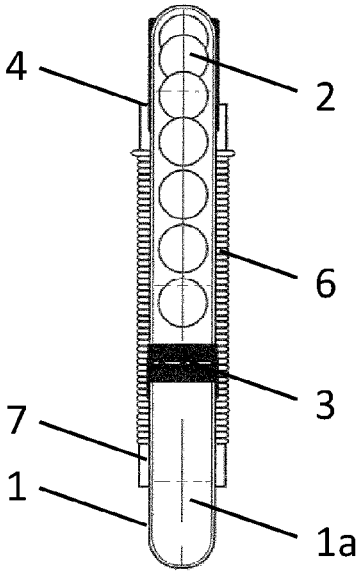
Figure 4:
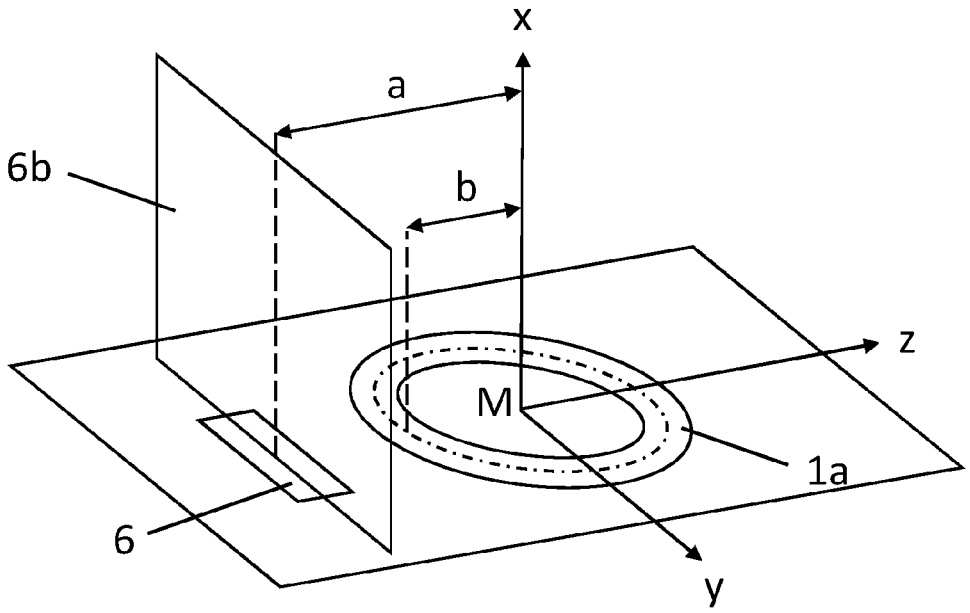
Figures 5A, 5B, 5C:
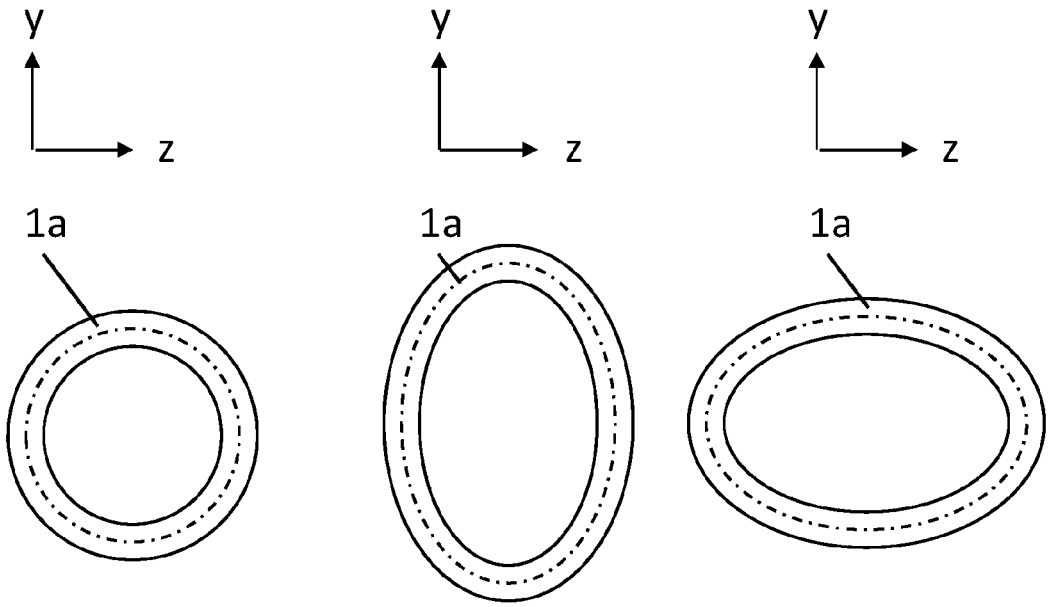
Figure 6A:
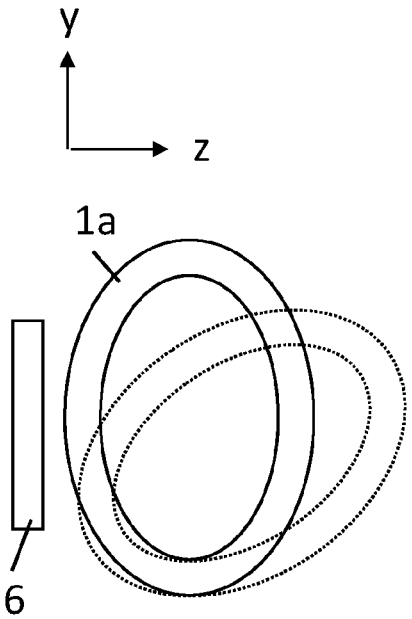
Figure 6B:
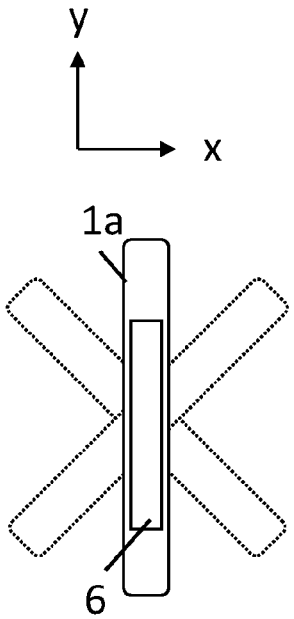
Figure 6C:
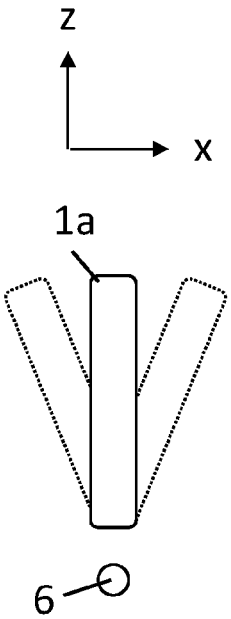
Figure 7A:
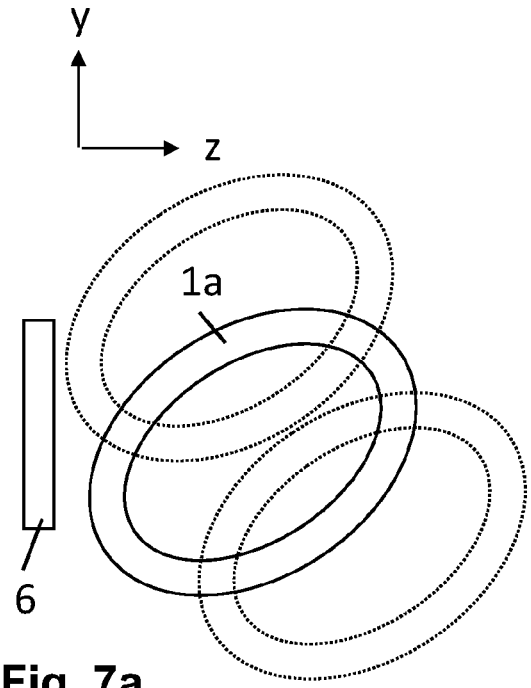
Figure 7B:
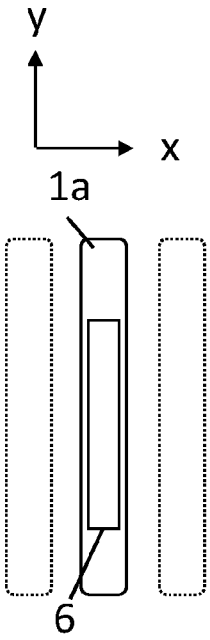
Figure 8A:
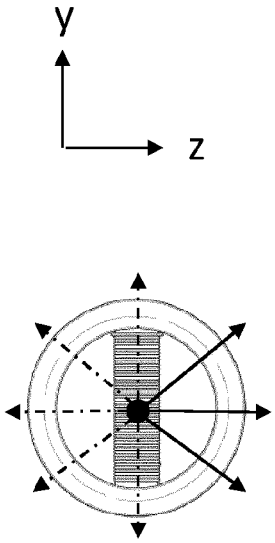
Figure 8B:
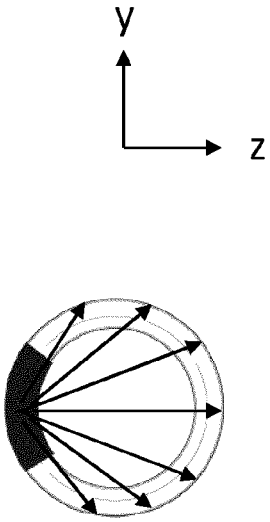
Figure 8C:
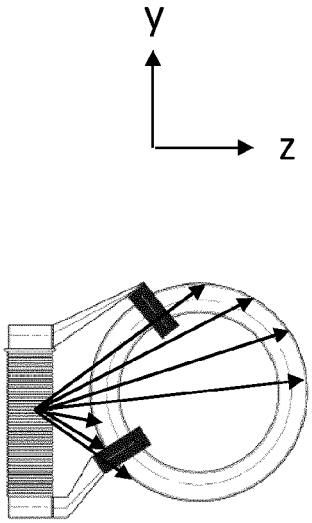
Figure 9A:
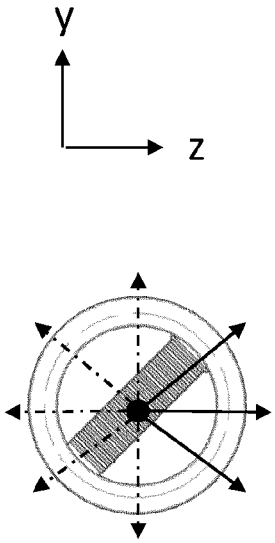
Figure 9B:
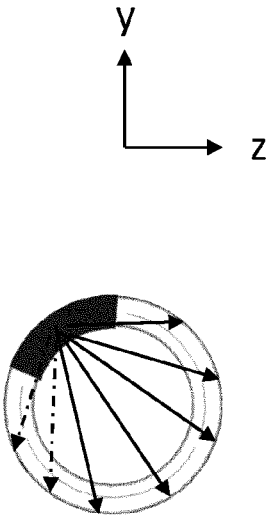
Figure 9C:
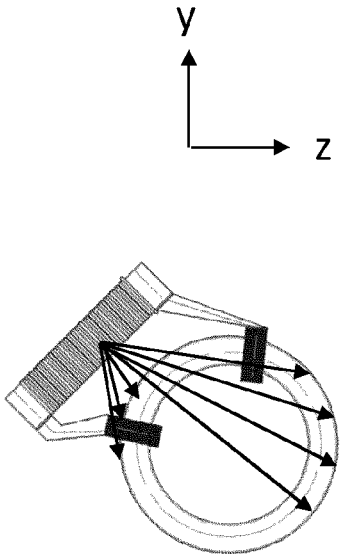

The invention is explained in more detail below with reference to the accompanying figures. The figures show in detail:

FIG. 1 a schematic side view of a training device in an exemplary embodiment;

FIG. 2 a schematic side view of a training device in a variant of the exemplary embodiment according to FIG. 1;

FIG. 3 a schematic front view of the training device according to FIG. 2 as viewed from a flywheel mass member carrier in the direction of a handle member;

FIG. 4 a schematic illustration of a flywheel mass member guide and the handle member in a flywheel mass member guide plane;

FIG. 5*a* a schematic side view of a flywheel mass member guide in a first embodiment;

FIG. 5*b* a schematic side view of a flywheel mass member guide in a second embodiment;

FIG. 5*c* a schematic side view of a flywheel mass member guide in a third embodiment;

FIG. 6*a* a schematic side view of a flywheel mass member guide according to FIG. 1 and the handle member with a pivoting of the flywheel mass member guide about an axis perpendicular to the flywheel mass member guide plane relative to the handle member;

FIG. 6*b* a schematic side view of a flywheel mass member guide according to FIG. 1 and the handle member with a pivoting of the flywheel mass member guide about an axis in the flywheel mass member guide plane and perpendicular to the handle plane relative to the handle member;

FIG. 6*c* a schematic side view of a flywheel mass member guide according to FIG. 1 and the handle member with a pivoting of the flywheel mass member guide about an axis in the flywheel mass member guide plane and parallel to the handle plane relative to the handle member;

FIG. 7*a* a schematic side view of a flywheel mass member guide according to FIG. 1 and the handle member with a displacement of the flywheel mass member guide in the flywheel mass member guide plane relative to the handle member;

FIG. 7*b* a schematic front view of a flywheel mass member guide according to FIG. 1 and the handle member with a displacement of the flywheel mass member guide parallel to the flywheel mass member guide plane relative to the handle member;

FIG. 8*a* a schematic side view of a training device according to a state of the art and illustration of the lever arm vectors in a vertical orientation of the handle member;

FIG. 8*b* a schematic side view of a training device according to a further state of the art and illustration of the lever arm vectors in a vertical orientation of the handle member;

FIG. 8*c* a schematic side view of a training device according to the invention and illustration of the lever arm vectors in a vertical orientation of the handle member;

FIG. 9*a* a schematic side view of the training device according to FIG. 7*a* and illustration of the lever arm vectors in an orientation of the handle member inclined to the vertical orientation;

FIG. 9*b* a schematic side view of the training device according to FIG. 7*b* and illustration of the lever arm vectors in an orientation of the handle member inclined to the vertical orientation; and FIG. 9*c* a schematic side view of the training device according to the invention according to FIG. 7*c* and illustration of the lever arm vectors in an orientation of the handle member inclined to the vertical orientation.

FIG. 1 shows a schematic side view of a training device 10 in an exemplary embodiment. The training device 10 comprises a flywheel mass member carrier 1 with a flywheel mass member guide 1*a* and a handle member 6 which is fastened to the flywheel mass member carrier 1 via two spacer members 5 with respective fastening members 4.

The flywheel mass member carrier 1 is formed here as an elliptical hollow ring, the cavity of which at the same time forms the flywheel mass member guide 1*a* as an elliptical path. In alternative embodiments, the flywheel mass member carrier may also have a different shape, which comprises a flywheel mass member guide 1*a* as a closed elliptical path arranged therein. In the guide channel of the flywheel mass member guide 1*a*, seven flywheel mass members 2 are arranged, which move circulatory in the guide channel, in particular may rotate therein. The initiation of the rotation of the flywheel mass members 2 is carried out by the arm swing during running with the training device 10. The flywheel mass members 2 are formed as spheres, which have a smaller outer diameter than the inner diameter of the guide channel of the flywheel mass member guide 1*a*. In alternative embodiments, the number of flywheel mass members 2 may also be greater or smaller than seven. The shape of the flywheel mass members 2 is also not restricted to spheres.

The handle member 6 has a handle axis 6*a*, which corresponds to an axis to be encompassed for gripping the handle member 6. The handle axis 6*a* lies in a flywheel mass member guide plane, which lies in the elliptical path of the flywheel mass member guide 1*a*. At the same time, the handle axis 6*a* lies in a handle plane 6*b* (FIG. 4) perpendicular to the flywheel mass member guide plane. The handle member 6 lies outside the elliptical path in the radial direction of the elliptical path. Accordingly, the handle plane 6*b* does not intersect the elliptical path. As a result of the distancing, the flywheel mass member guide 1*a* can always be held in a running direction z (FIG. 4) and the lever vectors are positive at least in the running direction z. In the embodiment shown, the handle member has a weight member 7 at one end in the direction of the handle axis 6*a*. If the end with the weight member 7 is oriented in the direction of the ground during running, i.e. in this case points downward, a balancing weight with respect to the flywheel mass member carrier 1 may be formed by this means. In the event of a different orientation or arrangement, also laterally outside the handle axis, the weight member 7 may also act merely as an additional weight and may optionally be used in a targeted manner for addressing specific muscles by permanent contraction.

The handle member 6 is fastened to the flywheel mass member carrier 1 via the two spacer members 7, to each of which a fastening member 4 adjoins at an end of the spacer members 7 opposite the handle member 6. In alternative embodiments, however, the handle member 6 may also be fastened to the flywheel mass member carrier 1 only by one spacer member 5 with a corresponding fastening member 4 or more than two spacer members 5 with corresponding fastening members 4. Here, the fastening members 4 are formed integrally with the spacer members 5, but may alternatively also be connected to the spacer members 5 in a different manner as separate fastening members 4. In the embodiment shown, the fastening members 4 are configured such that they may be arranged at different positions along the flywheel mass member carrier 1. Accordingly, the position of the handle member 6 relative to the flywheel mass member carrier 1 may be changed. In addition, an articulated connection of the spacer members 7 to the handle member 6 is provided, so that further relative positions may be achieved by this means, as will be described below with reference to FIGS. 6*a-c* and 7*a* and 7*b*.

FIG. 2 shows a schematic side view of a training device 10 in a variant of the exemplary embodiment according to FIG. 1. Here, the elliptical shape of the flywheel mass member carrier 1 or the flywheel mass member guide 1*a*, respectively, is formed or reinforced by an elastic deformation of the flywheel mass member carrier 1 or the flywheel mass member guide 1*a*, respectively, by means of a tensioning member 3. Here, by way of example, the tensioning member 3 is a rubber band, which may be arranged at different positions of the flywheel mass member carrier 1 and subjects two substantially opposite sides of the flywheel mass member carrier 1 to tensile stress in the direction towards one another. The flywheel mass member carrier 1 is accordingly flexible. The flywheel mass member carrier 1 and thus the flywheel mass member guide are thus adaptable in their shape. Here, the tensioning member 3 is displaceable along the flywheel mass carrier 1, so that the shape adaptation caused by the tensioning member 3 may also be performed in other radial directions. In alternative embodiments, further tensioning members may also be used for shaping.

FIG. 3 additionally shows a schematic front view of the training device 10 according to FIG. 2 as viewed from the flywheel mass member carrier 1 in the direction of a handle member 6. Here, the handle member 6 is arranged in the flywheel mass member guide plane.

FIG. 4 shows a schematic illustration of the flywheel mass member guide 1*a* and the handle member 6 in a flywheel mass member guide plane. Here, for the sake of simplicity, the flywheel mass member guide 1*a* is of circular shape, wherein the following is equally applicable to an elliptical shape deviating from a circular shape. The arrangement of the handle member 6 with respect to the flywheel mass member guide 1*a* is explained again with reference to FIG. 4. Here, the center point M as coordinate origin is the center point of the flywheel mass member guide 1*a* or the circular path, respectively. Here, the axis z designates a running direction to be assumed with respect to a runner. The axis y is an axis which points in the direction of the running surface. The axes y and z form the flywheel mass member guide plane. The axis x extends perpendicular to the flywheel mass member guide plane. The handle member 6 is located in a handle plane 6*b*, which extends perpendicular to the flywheel mass member guide plane, outside the flywheel mass member guide 1*a* at a radial distance a from the center point M. Thereby, the radial distance b between the circular path of the flywheel mass members 2 and the center point M is always smaller than the radial distance a. As a result, positive lever vectors are always achieved in the direction of the axis z or the running direction z, respectively.

FIG. 5*a* shows a schematic side view of a flywheel mass member guide 1*a* in a first embodiment. As an initial shape in the first embodiment, the flywheel mass member guide 1*a* is circular in the flywheel mass member guide plane.

Due to the circular embodiment of the flywheel mass guide 1*a*, the flywheel mass member 2 may swing along the circular path or rotate continuously along the circular path, respectively. The flywheel mass member 2 is, for example, uniformly accelerated independently of a pivot angle of the flywheel mass member guide 1*a* about an axis x perpendicular to the flywheel mass member guide plane relative to the handle axis 6*a* and may rotate very rapidly.

FIG. 5*b* shows a schematic side view of a flywheel mass member guide 1*a* in a second embodiment. In the second embodiment, the flywheel mass member guide 1*a* is elliptical in the flywheel mass member guide plane. The shorter side of the ellipse points in the direction of the z-axis.

Due to the elliptical flywheel mass member guide 1*a*, the stroke of the flywheel mass member 2 is increased here when orienting the long ellipse side in the vertical direction or the short ellipse side in the running direction, respectively, as a result of which a uniform rotation of the flywheel mass member 2 is still achievable with a comparatively low running speed and thus reduced amplitude of the arm swing.

FIG. 5*c* shows a schematic side view of a flywheel mass member guide 1*a* in a third embodiment. In the third embodiment, the flywheel mass member guide 1*a* is elliptical in the flywheel mass member guide plane as in FIG. 5*b*. However, the shorter side of the ellipse points here in the direction of the y-axis.

Due to the elliptical flywheel mass member guide 1*a*, the stroke of the flywheel mass member 2 is reduced here when orienting the long ellipse side in the horizontal direction, as a result of which a uniform rotation of the flywheel mass member 2 is still achievable with a comparatively high running speed and thus increased amplitude of the arm swing with increased acceleration.

According to the embodiments of FIGS. 5*b* and 5*c*, the acceleration behavior of the flywheel mass member 2 or of the flywheel mass members 2 may thus be influenced via the pivot angle of the elliptical flywheel mass member guide 1*a*. Intermediate pivot angles between the positions shown in FIGS. 5*b* and 5*c* each represent further adaptations of the acceleration behavior. The faster the running speed, the more advantageous may be a tilting of the flywheel mass member guide 1*a* from the position shown in FIG. 5*b* in the direction of the position shown in FIG. 5*c*.

FIG. 6*a* shows a schematic side view of a flywheel mass member guide 1*a* according to FIG. 1 and the handle member with a pivoting of the flywheel mass member guide 1*a* about an axis x perpendicular to the flywheel mass member guide plane relative to the handle member 6. The solid line shows an initial position of the flywheel mass member guide 1*a* and the dotted line shows a pivoting from the initial position. The pivot angle is 0 to 180°, preferably 0 to 120°, particularly preferably 0 to 90°. Here, the pivoting takes place by an articulated mounting of the spacer members 5, by which the flywheel mass member guide 1*a* may be pivoted relative to the handle member 6 about the axis x, i.e. an axis perpendicular to the flywheel mass member guide plane. The acceleration behavior of the flywheel mass members 2 may be adapted accordingly.

FIG. 6*b* shows a schematic side view of a flywheel mass member guide 1*a* according to FIG. 1 and the handle member 6 with a pivoting of the flywheel mass member guide 1*a* about an axis z in the flywheel mass member guide plane and perpendicular to the handle plane 6*b* relative to the handle member 6. The solid line shows an initial position of the flywheel mass member guide 1*a* and the dotted line shows a pivoting from the initial position. The pivot angle is +90° to −90°, preferably from +45° to −45°. Here, the pivoting takes place by an articulated mounting of the spacer members 5, by which the flywheel mass member guide 1*a* may be pivoted relative to the handle member 6 about the axis z, i.e. an axis parallel to the flywheel mass member guide plane and perpendicular to the handle plane 6*b*. The training device 10 may thus be configured such that it compensates for a pronation or supination, does not or actually provokes it or also specifically requests corresponding muscle groups. In addition, the acceleration behavior of the flywheel mass members 2 may also be further adapted via the different pivot positions.

FIG. 6*c* shows a schematic side view of a flywheel mass member guide 1*a* according to FIG. 1 and the handle member 6 with a pivoting of the flywheel mass member guide 1*a* about an axis y in the flywheel mass member guide plane and parallel to the handle plane 6*b* relative to the handle member. The solid line shows an initial position of the flywheel mass member guide 1*a* and the dotted line shows a pivoting from the initial position. The pivot angle is +90° to −90°, preferably from +22.5° to −22.5°. Here, the pivoting takes place by an articulated mounting of the spacer members 5, by which the flywheel mass member guide 1*a* may be pivoted relative to the handle member 6 about the axis y, i.e. an axis parallel to the flywheel mass member guide plane and to the handle plane 6*b*.

A different acceleration behavior of the flywheel mass members 2 may also result from this. Likewise, depending on the hand position, a targeted orientation relative to the running direction, i.e. relative to the axis z, may be provided.

FIG. 7*a* shows a schematic side view of a flywheel mass member guide 1*a* according to FIG. 1 and the handle member 6 with a displacement of the flywheel mass member guide 1*a* in the flywheel mass member guide plane relative to the handle member 6. The relative displacement may take place both in the direction of the axis y and the axis z. The spacer elements 5 run here for example in a guide rail. In alternative embodiments, the displacement may also take place via telescopic spacer members 5. A relative displacement may also take place via a rotational movement with or without a compensating movement. In the event of a compensating movement, a tilting caused by the rotation is withdrawn again, so that only a translational movement result remains. Combinations of translational and rotational relative movements may also be provided. The solid line again shows an initial position of the flywheel mass member guide 1*a* and the dotted line shows a displacement from the initial position.

In the event of a displacement of the flywheel mass member guide 1*a* relative to the handle axis 6*a* in the direction of the positive axis z, i.e. in the running direction, the distance between the flywheel mass member guide 1*a* and the handle axis 6*a* or the handle member 6, respectively, increases. As a result, the respective lever arm acting on the flywheel mass member also lengthens. In the event of a displacement of the flywheel mass member guide 1*a* relative to the handle axis 6*a* in the direction of the positive axis y, the lifting work required for the rotation of the flywheel mass members 2 increases. In addition, in the event of a displacement of the flywheel mass member guide 1*a* relative to the handle axis 6*a* in the direction of the positive axis y, the proportion of the compressive loads exerted by the weight of the flywheel mass members 2 increases. This also relates to the weight proportions of the flywheel mass member guide 1*a* and/or of the flywheel mass member carrier 1 which is/are then displaced relative in the direction of the positive axis y. Conversely, the weight proportions acting as tensile load increase in the event of a displacement of the flywheel mass member guide 1*a* relative to the handle axis 6*a* in the direction of the negative axis y. According to the above effects of a respective displacement in the direction of the axis z and/or the axis y, the training device may be adapted accordingly as required.

FIG. 7*b* shows a schematic front view of a flywheel mass member guide according to FIG. 1 and the handle member 6 with a displacement of the flywheel mass member guide 1*a* parallel to the flywheel mass member guide plane relative to the handle member 6. The relative displacement takes place in the direction of the axis x. The solid line again shows an initial position of the flywheel mass member guide 1*a* and the dotted line shows a displacement from the initial position. The displacement takes place via a relative pivoting of the spacer members 5 relative to the flywheel mass member guide 1*a* and the handle member 6. In alternative embodiments, alternatively or additionally, a guide mechanism may also be provided in the direction of the axis x at a connection of the spacer members 5 to the handle member 6 and/or to the flywheel mass member guide 1*a* or the flywheel mass member carrier 1, respectively.

The displacement of the flywheel mass member guide 1*a* parallel to the flywheel mass member guide plane relative to the handle member 6 may be used to adapt a torque about the axis z. By increasing the distance between the flywheel mass member guide 1*a* and the handle member 6 parallel to the flywheel mass member guide plane, a force may be increased, which has to be compensated for to avoid a pronation or supination. Alternatively, a specific hand position may also be provoked by the force effect.

The above-described rotational and translational relative movements may be superimposed.

FIG. 8*a* shows a schematic side view of a training device according to a state of the art and illustration of the lever arm vectors in a vertical orientation of the handle member. The lever vectors running in the running direction, i.e. positive direction of the axis z, are indicated by continuous arrows. Negative lever vectors with respect to the running direction, i.e. in negative direction of the axis z, are illustrated by dashed arrows. As a result of central arrangement of the handle member, negative lever vectors also always occur with respect to the running direction.

FIG. 8*b* shows a schematic side view of a training device according to a further state of the art and the illustration of the lever arm vectors in a vertical orientation of the handle member. Here, the handle member is arranged on the flywheel mass member guide. In a vertical orientation of the handle member, i.e. an orientation in the direction of the axis y, all lever vectors in the running direction, i.e. in positive direction of the axis z, are positive. However, in the event of a tilting, this changes, as is shown below in FIG. 9*b*. If the handle member is additionally moved into a position in which the flywheel mass member coincides with the handle member, no lever vector is applied at all. Thus, for example, if the handle member is rotated counter-clockwise by 90° starting from the position shown in FIG. 8*b*, the flywheel mass member also lies in the region of the handle member due to gravity, such that no significant lever can be applied any more in order to set the flywheel mass member in rotation. Here, the counter-clockwise direction of rotation relates to the arrangement shown in FIG. 8*b*. Here, the above explanation assumes that this position of the handle member with respect to a ground represents the lowest point.

FIG. 8*c* shows a schematic side view of a training device 10 according to the invention and illustration of the lever arm vectors in a vertical orientation of the handle member 6. Here, the lever arm vectors are likewise always positive due to the handle member 6 spaced apart from the flywheel mass member guide 1*a*. For comparison purposes, the flywheel mass member guide is illustrated here in a circular manner representative of an elliptical configuration.

FIG. 9*a* shows a schematic side view of the training device according to FIG. 8*a* and the illustration of the lever arm vectors in an orientation of the handle member inclined to the vertical orientation. As a result of the central handle member, there is no change in the lever vectors even in the event of tilting. These remain partially negative.

FIG. 9*b* shows a schematic side view of the training device according to FIG. 8*b* and the illustration of the lever arm vectors in an orientation of the handle member inclined to the vertical orientation. As a result of the tilting of the training device and thus of the handle member, part of the lever vectors now become negative during the tilting proceeding from a vertical orientation of the handle member.

FIG. 9*c* shows a schematic side view of the training device 10 according to the invention according to FIG. 8*c* and the illustration of the lever arm vectors in an orientation of the handle member 6 inclined to the vertical orientation. The lever vectors also always remain positive during the tilting of the training device 10. Although negative lever vectors could occur in principle in the case of an extreme tilting, these would be accompanied by an anatomically unacceptable hand position during running training. For comparison purposes, the flywheel mass member guide is illustrated here in a circular manner representative of an elliptical configuration.

The invention is not restricted to the described embodiments. Even if equally large and uniform flywheel mass members are used in the above-described embodiments, the flywheel mass members may also be different. The flywheel mass members may likewise have a different dead weight and/or be accordingly exchangeable. For example, the size and/or the thickness of the flywheel mass member guide or of the flywheel mass carrier, respectively, may also vary. The training device may be used not only during jogging and other walking activities, but also for strength exercises without additional walking.

LIST OF REFERENCE SIGNS

1 flywheel mass member carrier
1*a* flywheel mass member guide
2 flywheel mass member
3 tensioning member
4 fastening member
5 spacer member
6 handle member
6*a* handle axis
6*b* handle plane
7 weight member
10 training device
a radial distance between the radial center point of the elliptical or circular path and the handle plane
b radial distance between the radial center point of the elliptical or circular path and the elliptical path
M radial center point of the elliptical or circular path
x, y, z coordinate system

The invention claimed is:

1. Training device for training the arm muscles and muscle groups associated therewith, comprising:

at least one flywheel mass member carrier with at least one flywheel mass member guide (1*a*) for guiding at least one flywheel mass member along at least one elliptical path deviating from a circular shape or at least one elliptical path segment, wherein the flywheel mass member guide forms a guide of the at least one flywheel mass member extending beyond a semi-ellipse and spans a flywheel mass member guide plane in the radial direction of the elliptical path or the elliptical path segment, and at least one handle member with a handle axis to be encompassed for gripping, wherein the handle member is arranged in the handle axis at least sectionally in a handle plane which extends perpendicular to the flywheel mass member guide plane and which does not intersect the elliptical path or the elliptical path segment, and wherein the handle axis is positionable via at least one spacer member and/or at least one fastening member at a predetermined distance and/or at a predetermined angle in three axes to the flywheel mass member guide.

2. The training device according to claim 1, wherein the flywheel mass member guide forms a guide channel in which the at least one flywheel mass member is guided along the elliptical path or the elliptical path segment.

3. The training device according to claim 1, wherein the flywheel mass member guide forms a continuous at least sectionally elliptical path or sectionally circular path for continuously guiding the at least one flywheel mass member.

4. The training device according to claim 3, wherein, perpendicular from the radial center point of the at least partially elliptical path or the partially circular path on the handle plane, a radial distance from the radial center point of the at least partially elliptical path or the partially circular path to the handle plane is greater than a radial distance from the radial center point of the at least partially elliptical path or the partially circular path to the at least partially elliptical path or to the partially circular path.

5. The training device according to claim 1, wherein the flywheel mass member guide is elastically deformable via at least one tensioning member.

6. The training device according to claim 1, wherein the at least one spacer member and/or the at least one fastening member is configured to oscillate.

7. The training device according to claim 1, wherein the positioning of the handle axis in relation to the flywheel mass member guide is variable via the at least one spacer member and/or the at least one fastening member.

8. The training device according to claim 7, wherein a pivot angle of the flywheel mass member guide about an axis perpendicular to the flywheel mass member guide plane relative to the handle axis is variable via the at least one spacer member and/or the at least one fastening member.

9. The training device according to claim 7, wherein a pivot angle of the flywheel mass member guide about an axis in the flywheel mass member guide plane and perpendicular to the handle plane relative to the handle axis is variable via the at least one spacer member and/or the at least one fastening member.

10. The training device according to claim 8, wherein the pivot angle of the flywheel mass member guide about an axis perpendicular to the flywheel mass member guide plane relative to the handle axis is variable via the at least one spacer member and/or the at least one fastening member in a range from 0 to 180°.

11. The training device according to claim 8, wherein the pivot angle of the flywheel mass member guide about an axis perpendicular to the flywheel mass member guide plane relative to the handle axis is variable via the at least one spacer member and/or the at least one fastening member in a range from 0 to 90°.

12. The training device according to claim 8, wherein the pivot angle of the flywheel mass member guide about an axis in the flywheel mass member guide plane and perpendicular to the handle plane relative to the handle axis is variable via the at least one spacer member and/or the at least one fastening member in a range from +90° to −90°.

13. The training device according to claim 8, wherein the pivot angle of the flywheel mass member guide about an axis in the flywheel mass member guide plane and perpendicular to the handle plane relative to the handle axis is variable via the at least one spacer member and/or the at least one fastening member in a range from +45° to −45°.

14. The training device according to claim 8, wherein the pivot angle of the flywheel mass member guide about an axis in the flywheel mass member guide plane and parallel to the handle plane relative to the handle axis is variable via the at least one spacer member and/or the at least one fastening member in a range from +90° to −90°, preferably from +22.5° to −22.5°.

15. The training device according to claim 8, wherein the pivot angle of the flywheel mass member guide about an axis in the flywheel mass member guide plane and parallel to the handle plane relative to the handle axis is variable via the at least one spacer member and/or the at least one fastening member in a range from +22.5° to −22.5°.

16. The training device according to claim 7, wherein a pivot angle of the flywheel mass member guide about an axis in the flywheel mass member guide plane and parallel to the handle plane relative to the handle axis is variable via the at least one spacer member and/or the at least one fastening member.

17. The training device according to claim 7, wherein a distance of the flywheel mass member guide relative to the handle axis is variable via the at least one spacer member and/or the at least one fastening member in at least one direction in the flywheel mass member guide plane and/or in a direction perpendicular to the flywheel mass member guide plane.

18. The training device according to claim 1, wherein the handle member is configured for attaching at least one weight member and/or comprises the latter.

19. The training device according claim 1, wherein the type and/or number of flywheel mass members is variable.

20. The training device according to claim 1, wherein the flywheel mass member guide at least in a possible contact region with the at least one flywheel mass member and/or the at least one flywheel mass member has a profiling and/or coating.

* * * * *